US005520227A

United States Patent [19]

Kelley

[11] Patent Number: 5,520,227

[45] Date of Patent: May 28, 1996

[54] TOOL FOR FORMING CONTROLLED BENDS IN WIRE

[75] Inventor: Ronald G. Kelley, Laurel, Md.

[73] Assignee: The Electrician's Buddy, Clarksville, Md.

[21] Appl. No.: 275,740

[22] Filed: Jul. 19, 1994

[51] Int. Cl.[6] ..... B21F 3/00

[52] U.S. Cl. ..... 140/102.5; 140/106; 140/117; 7/108

[58] Field of Search ..... 140/52, 54, 57, 140/102.5, 106, 117, 118, 123; 7/108; 72/479

[56] References Cited

U.S. PATENT DOCUMENTS

| | | | |
|---|---|---|---|
| 789,941 | 5/1905 | Sibley . | |
| 2,326,090 | 8/1943 | Yadon . | |
| 2,430,199 | 11/1947 | Frank . | |
| 2,507,059 | 5/1950 | Suman | 140/123 |
| 2,546,489 | 3/1951 | Wright | 7/108 |
| 2,937,669 | 5/1960 | Lemke | 7/108 |
| 3,095,912 | 7/1963 | Sullivan . | |
| 3,168,118 | 2/1965 | Holman | 140/118 |
| 3,202,186 | 8/1965 | Luberacki . | |
| 3,253,286 | 5/1966 | Bacon . | |
| 4,060,305 | 11/1977 | Poliak et al. . | |
| 4,257,159 | 3/1981 | Wingert . | |
| 4,751,840 | 6/1988 | Windsor . | |

*Primary Examiner*—Daniel C. Crane
*Assistant Examiner*—Ed Tolan
*Attorney, Agent, or Firm*—Nath & Associates; Irvine A. Lavine

[57] ABSTRACT

A tool for forming a controlled bend in a wire to be positioned around a terminal screw or post. The tool has a wire bending head at one end of a shaft which has a handle at the opposite end, the wire bending head including a post coaxial with the shaft and an arcuate flange outwardly of the shaft. A second flange is spaced from the first flange, and the two flanges provide stops. The end of a wire is placed adjacent to the post and is inserted between the flanges; in an alternate embodiment, there is a single flange with a transverse opening in which the end of the wire is placed. The tool is rotated while the wire is held, or the wire may be moved with or without tool rotation, so that the wire is bent around the post. Bending continues until the wire engages a second stop, which is located to position the two legs of the bent wire in a desired relative position, which may be substantially parallel. A generally S-profile wire pusher element having a transverse annular element is provided for assisting in bending stiff wire. The tool may have coplanar blades for turning a screw.

22 Claims, 3 Drawing Sheets

TOOL FOR FORMING CONTROLLED BENDS IN WIRE

BACKGROUND OF THE INVENTION

This invention relates to a tool for bending wire to form a controlled bend in it, and more particularly to a tool for bending electrical wires.

Electrical wires are typically in the form of a cylinder of indeterminate length, and encased within an insulating sheath. The electrical wire may be a single strand, or may be a plurality of strands twisted in helical fashion to form an approximately cylindrical configuration. These wires are of various diameters, materials, and stiffness. In use, a portion of the insulation, at an end of the wire, is removed, and the bare wire is then formed into a controlled bend. The controlled bend has an arcuate portion or bight with a relatively straight portion or leg at each end. It is desirable that the two legs be parallel, or approximately parallel, for ease of assembly to a contact. Typically, the contact is a screw having a threaded shaft and a slotted head of substantially larger diameter than the shaft, the controlled bend being placed so that the two legs straddle the threaded shaft of the screw, and are beneath the head of the screw. After positioning the controlled bend of the wire in this manner, the screw is tightened, so that the underside of the head of the screw engages the electrical wire controlled bend and presses it against another part of the contact structure.

To form the controlled bend in the electrical wire, pliers are typically used, the workman grasping one end portion of a generally straight wire, without insulation on the end portion, and bends the wire to form a controlled bend. Care and skill are required to form the controlled bend in the wire so that the legs are in the desired relation to each other. If the leg at the free end of the wire is not bent far enough, that is, is bent through significantly less than 180°, there will result a bend which is of an open V-shape, which provides a structure which might be too large to be positioned in the terminal structure, due to parts providing a limited space for the bent wire. When this occurs, time is consumed in rebending the wire with the intent of making the two legs substantially parallel, but care must be taken to avoid bending the leg forming the free end of the wire too much for, in that event, the leg forming the free end of the wire will substantially close the opening which is used for the straddling of the screw shank by the two legs of the bent wire. Also, if too much force is initially applied to the wires, a closed loop will be formed, prohibiting manipulation of the wire so as to straddle the screw shank.

In addition to pliers, there have been provided various wire bending tools for use in bending electrical wires, and other wires, an example of which is Bacon U.S. Pat. No. 3,253,286, in which there is a loop forming tool having a screwdriver with a handle and a shank, and a blade extending generally parallel to, but located radially outwardly of, the shank. An end of a wire is placed between the shank and the blade, and the screwdriver is rotated to form a substantially closed loop in the end of the wire. The amount that the wire is bent, and therefore the relationship of the legs of the bend, is dependent upon the skill and strength of the workman, and the stiffness of the wire, so that bends of the desired configuration are not readily obtainable.

Sibley U.S. Pat. No. 789,941, Frank U.S. Pat. No. 2,430,119, and Sullivan U.S. Pat. No. 3,095,912 provide screwdrivers with an axially extending tang adjacent to the blade of the screwdriver, the tang engaging an end portion of a wire and bending it around a screw as the screwdriver blade engages the slot in the screw head, thereby tightening the screw and forming a bend in the wire.

Windsor U.S. Pat. No. 4,751,840 provides a tool for making bends in a wire comprising a tool having a shaft with a square drive-end engaged in a mandrel having two pins spaced from each other and parallel to the axis of the shaft, for bending wire approximately 90°.

Wingert U.S. Pat. No. 4,257,159 provides a wire bending tool including a handle having a shank extending from it in which there is a radially extending hole. An end of a wire is inserted into the hole, and the wire is rotated around the shank to partly form a loop, the extent of the radius of the bend being determined by the diameter of the shank, and therefore not being suitable for a variety of thicknesses of wire.

Yadon U.S. Pat. No. 2,326,090 provides a terminal connector which comprises a disc with a hole, through which the shank of a terminal screw is passed. The disc has a pair of upstanding flanges, which are spaced apart. A wire is passed adjacent the shank of the screw, and between the spaced flanges, after which a screwdriver is used to rotate the screw and the washer to bend the wire about the screw shank.

Poliak et al U.S. Pat. No. 4,060,305 provides a terminal construction having as a part of it a loop forming tool. The tool portion comprises a solid base having a stepped cavity extending into it, the base being formed adjacent to the cavity with a rounded shoulder which is tangent to the cavity and to an outer wall of the base. The end of a wire is inserted into the cavity, and the wire is bent around the shoulder until it engages the side of the device; the wire is then placed on a screw forming part of the wire terminal.

The tools of Sibley, Frank, Windsor and Yadon have the same deficiencies as noted above in connection with Bacon. Consequently, these tools are not able to form controlled bends in a consistent and conventional manner, and cannot provide a controlled bend in which the legs are substantially parallel. With all of these tools, great care is required in order to achieve the formation of a bend of optimum configuration for placing on the threaded shank of a terminal screw. Poliak et al is a combined terminal and tool device, and is not a separate, readily used workman's tool for making controlled bends in wires in preparation for placement of the wires on electrical terminal screws separate from the tool.

SUMMARY OF THE INVENTION

There is provided a tool for forming a controlled bend in a wire in a ready and facile manner and for forming the controlled bend so that the legs are substantially parallel. The tool has a wire bending head at one end of a shaft which has a handle at the opposite end. The bending head includes a post which is coaxial with the shaft of the tool, and two circumferentially spaced flanges outwardly of the post, one flange providing a stop for the free end of the wire having a radius on the inside shoulder closest to the post which may be coated, so that the free end of the wire will not be marred. This stop which will form the first leg of a controlled bend and the other flange having a shoulder providing a second stop which will be engaged by the portion of the wire which will form the other leg of the controlled bend, when that other leg is substantially parallel to the first leg.

In an alternate embodiment, an upstanding flange is outwardly of the post, and extends generally parallel to the post; the flange has a transverse opening through it, and a shoulder. The end of a wire is passed adjacent the post, and through the opening, and then the wire is bent about the post, and/or the tool is rotated, bending proceeding until the leg of the loop engages the shoulder on the flange.

In a further alternate embodiment, the post is removable or retractable, and the flanges extend preferably in diametrically opposite relationship, each flange having an inwardly directed blade for entry into the slot of a screw, for use as a screw driver for turning a terminal screw about a wire which has been controllably bent by the tool.

A wire pusher is provided, which is an element of metal, or the like, which is generally S-shaped in profile, and having at least two arcuate portions, one arcuate portion being larger in arcuate extent than the other arcuate portion.

Among the objects of the present invention are to provide a wire bending tool which will readily form a controlled bend in a wire by bending the wire, and which will establish a controlled bend in which the legs are substantially parallel.

Another object of the present invention is the provision of a wire bending tool in which a tool having a handle, a shaft and bending head may receive a wire and bend it through any desired extent, substantially an arc of 180°, by increasing or decreasing the circumferential length of a flange of the tool.

Still another object of the present invention is to provide a tool for forming loops in wire in which a controlled bend with substantially parallel legs may be formed in wires of various sizes and of differing stiffness, and a further object of the present invention is to provide such a tool which is readily used, permits ready association of a wire with the tool, convenient and ready bending of the wire, and ease of removal of the wire with a controlled bend formed in it from the tool.

In addition, an object of the present invention is to provide a wire pusher device for use in association with a controlled wire bending tool, which will enable the forming of a controlled bend in a wire which is of relatively great stiffness with a wire bending tool.

These and other objects and many of the attendant advantages of the present invention will be readily understood from the following specification and claims, and by reference to the appended drawings.

DESCRIPTION OF THE PREFERRED EMBODIMENTS

Figure 1:
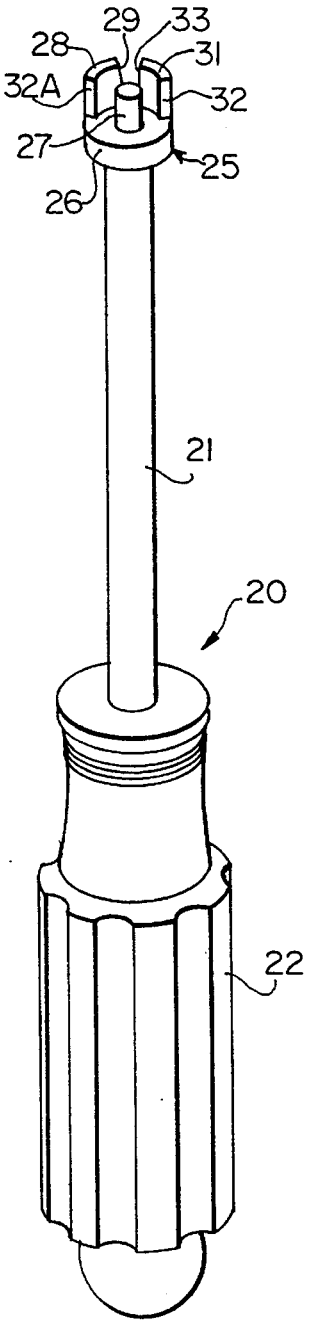
FIG. 1 is a perspective view of a tool for forming controlled bends in wire in accordance with the present invention.
Figure 10:
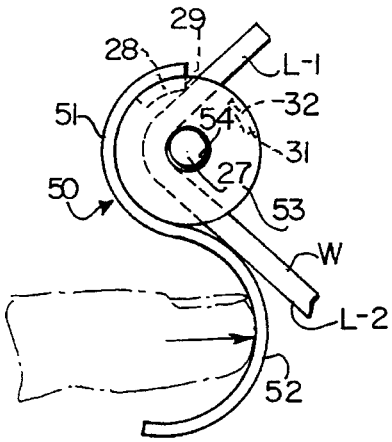
FIG. 10 is a plan view showing a portion of the tool of FIG. 1, the wire pusher of FIG. 9, and a relatively stiff wire being bent.

Referring now to the drawings, wherein the same or similar reference numerals are used to designate the same or similar parts throughout the several views, there is shown in FIG. 1 a tool 20 for bending wire to form a controlled bend in the wire, the tool 20 comprising a shaft 21 having a handle 22 at one end thereof, and being of conventional construction, the shaft 21 having a bending head generally designated 25 at the opposite end thereof. The bending head 25 comprises a disc or similar element 26 having an abutment provided by a cylindrical post 27 centrally thereof, and generally coaxial with the shaft 21. A first generally axially extending abutment flange 28 projects from the disc 26 and lies outwardly of the post 27. Flange 28 has a wire pushing surface 29 provided by an inclined edge thereof. A second abutment flange 31 also lies outwardly of the post 27 and, like the abutment flange 28, extends in a generally axial direction, preferably parallel to post 27. The abutment flange 31 has a stop 32 formed by a face or edge thereof, opposite which is a surface 33, which is spaced sufficiently from the inclined surface 29 to permit a wire to be passed therebetween. The surface 29 and/or the surface 33 may relatively converge, as shown in FIG. 10, being wider at the entry thereof remote from disc 26, and converging generally towards the post 27.

Figure 2:
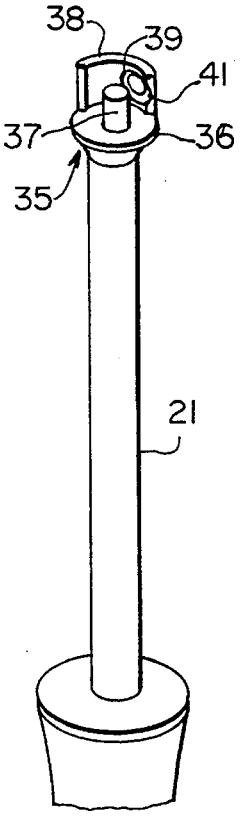
FIG. 2 is a perspective view, with parts removed, of an alternate embodiment of a tool in accordance with the present invention.
Figure 3:
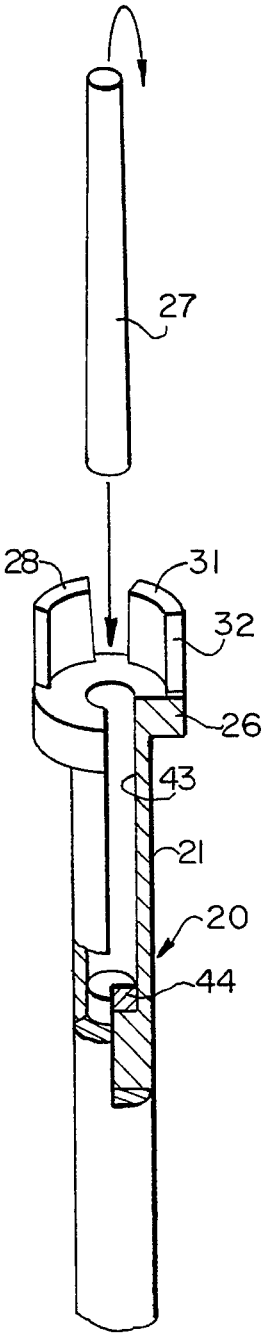
FIG. 3 is an elevational view of a double-ended post for use with the tool.

The embodiment shown in FIGS. 1–3 may be used for either left hand or right hand operation since there is optionally a stop 32 on the flange 31, for left hand operation, and there is a stop 32A on flange 28, for right hand operation. As will be appreciated, the circumferential extent of the flanges 28 and 31 will be substantially identical to obtain the same degree of forming of the wire. It will be appreciated, however, that it is contemplated that the circumferential extent of the flanges 31 and 28 may not be equal, to thereby give a different degree of bending, depending on whether the rotation of the tool is in one direction (left hand) or the other direction (right hand). Further, when the tool is to be used for left hand or right hand operation, the wire W will be on one side or the other of the post, FIGS. 4–7 illustrating left hand rotation and placement of the wire W.

In FIG. 2, there is shown an alternate embodiment of the invention in accordance with the present invention in which on the end of shaft 21 there is a bending head 35 comprising a disc or the like 36, and a cylindrical post 37 which is coaxial with the shaft 21. A single preferably arcuate flange 38 is outwardly of the post 37 and extends in a generally axial direction. The flange 38 has an opening 39 therethrough, and spaced from the opening 39 there is an end face 41 of the flange.

Figure 3A:
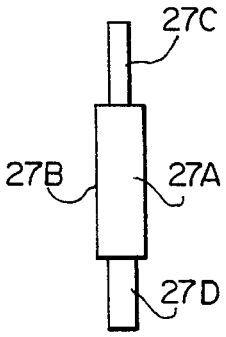
FIG. 3A is an elevational view of an alternate embodiment of the post.

Referring now to FIG. 3, there is shown the tool 20, the shaft 21 having an axially extending bore 43, bore 43 also extending through the disc 26. In the bottom of the bore 43 is a magnet 44. The post 27 is tapered, and of such size that either end thereof may be placed into the bore 43 to be releasably held by the magnet 44. The user may place either the larger end or the smaller end of the post 27 against the magnet 44, so that either end may extend beyond the disc 26, and cooperate with the abutment flanges 28 and 31 in a manner to be described below. As will be apparent, the post 27, rather than being tapered, may be stepped, to provide ends with differing diameters having a center portion, which is almost the same diameter as bore 43, in order to facilitate stability of post 27, as seen in FIG. 3A. This facilitates the utilization of the wire bending tool with wires of different diameter, since the diameter of the wire and of the post, and the location of stops 29 and 32 are interrelated.

In FIG. 3A, there is shown an alternate post 27A having a central cylindrical portion 27B sized to engagingly fit in bore 43, with a relatively small cylindrical post 27C at one end and a larger cylindrical post 27D extending from the opposite end. The post 27A may be placed in bore 43 of the tool 20 with either the smaller post 27C or the larger post 27D in operative position. The post 27 and the flanges 28 and 31 may be coated, as with a plastic such as Teflon, to prevent marring or scoring of the wire as it is being bent.

Figure 4:
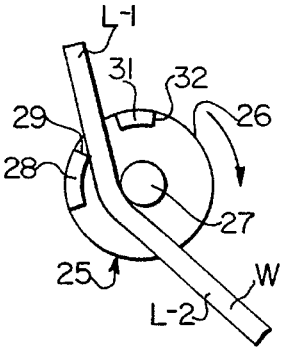
FIGS. 4, 5, 6 and 7 are plan views showing the bending of a wire to form a controlled bend, and the removal thereof, by the tool shown in FIG. 1.

The construction and use of the wire bending tool in accordance with the present invention is illustrated in FIGS. 4–7. In FIG. 4, a wire W, such as an electrical conducting wire, is shown together with a plan view from above of the bending head 25. The free end of a wire W has been passed adjacent to the post 27 and in the opening or slot between the abutment flanges 28 and 31. Considering that the wire W is initially substantially cylindrical, a theoretical line on the surface of the wire W extending parallel to the axis thereof is an "element". After the wire W has been passed through the space between the abutment flanges 28 and 31, a portion of the wire W remote from the free end thereof will be held by the operator, while the tool 20 is rotated in the direction of the arrow on FIG. 4. Stop 29, which may be a surface or an edge, will engage an element of the wire W which is opposite to an element engaged by the post 27. As shown in FIG. 4, the wire W has been bent through approximately 30°, so that there has been formed a controlled bend in the wire W around the post 27 of approximately 30°, providing a first leg L-1 and a second leg L-2.

Figure 5:
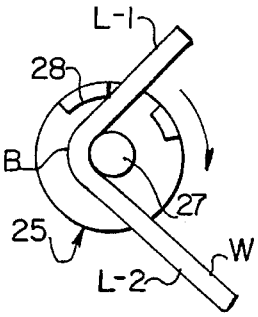
Figure 6:
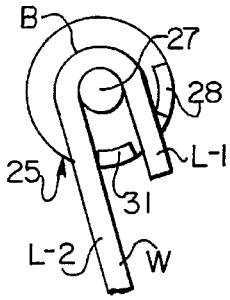

FIG. 5 shows the positions of the legs L-1 and L-2 of the wire W as rotation of the tool 20 continues in the direction of the arrow, there now being a bight B formed around the post 27, the legs L-1 and L-2 being at approximately 90° to each other. FIG. 6 shows the wire W after still further rotation of the tool 20 in the same direction, rotation being stopped by engagement of an element of leg L-2 of the wire W with the stop 32 on abutment 31. Stops 29 and 32 are relatively located to establish a predetermined relationship between the legs L-1 and L-2; specifically, the legs L-1 and L-2 are substantially parallel when the bight B engages the post 27 and the legs engage the stops 29 and 32.

Figure 7:
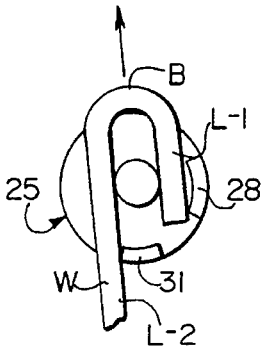

In FIG. 7, the wire W is shown being removed from the bending head 25, having been pushed up by a force on leg L-2 generally transverse thereof, thereby withdrawing leg L-1 from the slot between the abutments 28 and 31. This enables easy removal of the wire W from the tool 20.

Figure 8:
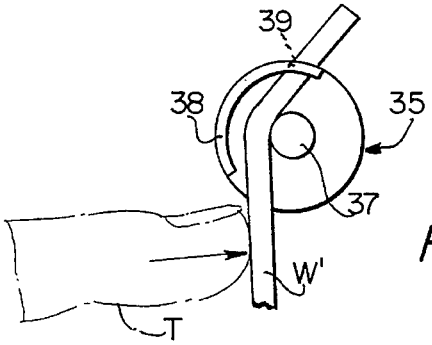
FIG. 8 is a plan view of a tool in accordance with FIG. 2, and having a relatively stiff wire therein being bent by the force of a finger.

In FIG. 8, there is shown a wire W' in association with the bending head 35 of a bending tool in accordance with the present invention. The resistance of the wire W' to bending is overcome by the advantage of rotation leverage applied by the tool. In FIG. 8, a free end of the wire W' has been passed adjacent to the post 37 and through the opening 39 in the flange 38. Opening 39 is substantially larger in diameter than the wire W', to enable ready insertion of wire W' therethrough. To obtain the advantage of leverage, a thumb T of the operator is positioned on the wire W' as shown, and while the handle of the tool is firmly held, the portion of the wire W' opposite the free end thereof will be pushed in the direction of the arrow, the wire W' engaging the post 27 and a part of the boundary of the opening 39. As will be appreciated, the bending of the wire W' may be effected either solely by the force applied by the thumb T or by a combination of that force and a rotational force applied to the handle of the tool.

Figure 9:
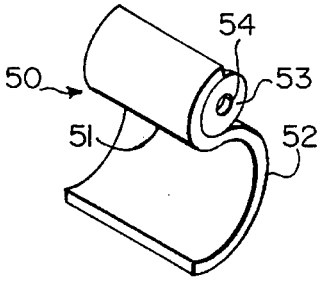
FIG. 9 is a perspective view of a wire pusher for use in association with the tool of FIG. 1 or FIG. 2.

Due to the fact that operation as illustrated in FIG. 8 may under certain circumstances be painful and/or injurious to the thumb or fingers of the user, there has been provided, as shown in FIG. 9, a wire pusher 50 which is preferably of metal, and is a curved plate of generally S-shaped profile, having an upper arcuate portion 51 facing in one direction and a lower, and preferably larger in arcuate extent arcuate portion 52 facing in the opposite direction. An annular member 53, having an opening 54, is placed at the end of the arcuate portion 51. FIG. 10 shows the manner of using the wire pusher 50, with a wire W-1 and a bending tool, in this instance the bending tool 20. In FIG. 10, there may be seen the leg L-1 of the wire W-1 which has been passed through the slot between the stop 29 of abutment flange 28, and the stop 32 of abutment flange 31. In this view, the inclination of the stop 29 is readily seen, this construction providing a ready entry and removal of wire W into and from the slot or opening between the stops 29 and 33. The wire pusher 50 is shown with the post 27 extending through the hole 54 of annular member 53, the under side of the annular member resting on the abutments 28 and 31. The arcuate portion 51 may engage the disc 26 and the exterior of the abutments 28 and 32 in a manner by which it is journalled on these elements of the tool 10. The convex surface of arcuate portion 52 engages the leg L-2 of wire W, and by either rotation of the tool 10 or annular movement of the pusher 50, or both, the leg L-2 is caused to be bent, to form a predetermined bend, that is, is bent through a predetermined arc. Thereby, pain and/or injury of the thumb or finger of the operator is avoided.

Figure 11:
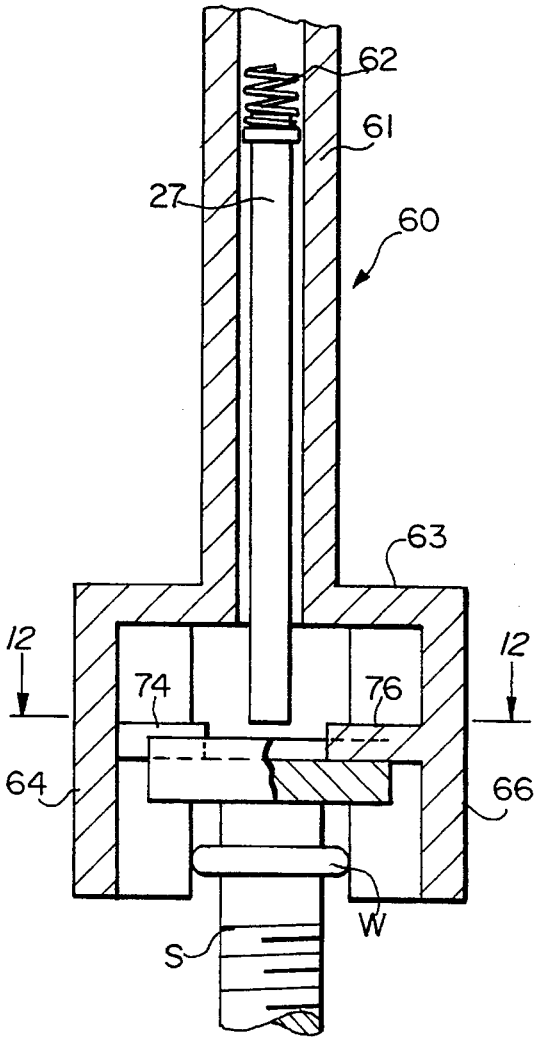
FIG. 11 is a cross-sectional view of a combined wire forming tool and screwdriver.
Figure 12:
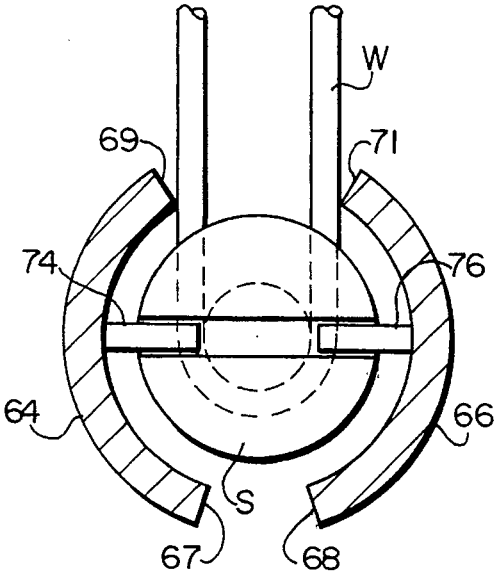
FIG. 12 is a cross-sectional view taken on the line 12—12 of FIG. 11.

In FIGS. 11 and 12, there is shown a combined wire bending tool and screwdriver 60 comprising a hollow shaft 61 in which there is a spring 62. The post 27 is axially movable in the hollow shaft 61, and may compress the spring 62 so that it extends to a lesser extent from the hollow shaft 61. At the end of the hollow shaft 61, there is a disc 63 having two arcuately extending abutment flanges 64 and 66. As shown in FIG. 12, the arcuate flanges 64 and 66 have stops 67 and 68 in spaced apart relationship, to provide a slot for receiving a wire, and also have stops 69 and 71 for acting as an abutment to determine the extent of bending of a wire in either the left hand or right hand direction of rotation of the tool 60. Extending inwardly from the abutment 64 is a blade 74, and extending inwardly from the abutment 66 is a blade 76. As will be seen in FIGS. 11 and 12, the blades 74 and 76 are coplanar, but do not extend completely across the space between the abutment flanges 64 and 66, thereby providing a space between them for the post 27.

In use, after a wire has been controllably formed by rotation of the tool 60, the wire may be placed as shown in FIG. 11 about a terminal screw S, and the tool 60 is then positioned on the terminal screw S as shown in FIG. 11 with the post 27, if permitted to remain in the hollow shaft 61, being caused to retract into the bore of hollow shaft 61 against the force of spring 62, thereby compressing the spring as the tool 60 is moved downwardly. The abutments 64 and 66 are outwardly of the head of the terminal screw S; the blades 74 and 76 may enter into the slot in the head of terminal screw S and upon rotation of tool 60, the terminal screw S will be rotated to optionally apply torque to the wire W to further bend the wire, and whether or not torque is applied to the wire W, rotation of tool 60 will cause rotation of the terminal screw S to clamp the wire W by the axial movement of the terminal screw S.

The claims and specification describe the invention presented, and the terms that are employed in the claims draw their meaning from the use of such terms in the specification. Some terms employed in the prior art may be broader in meaning than specifically employed herein. Whenever there is a question between the broader definition of such term as used in the prior art and the more specific use of the term herein, the more specific meaning is meant.

What is claimed is:

1. A tool for bending a wire and to form a controlled bend with the legs of the bent wire in a predetermined relationship, said tool comprising:

(a) a wire bending means, (b) handle means for said wire bending means for causing rotation of said wire bending means about an axis, (c) said wire bending means comprising:

(i) an abutment substantially on said axis for engagement by a wire extending in a plane transverse to said axis, (ii) means spaced from said abutment for pushing a first leg of a wire engaging said abutment upon rotation of said wire bending means about said axis to thereby form a bend in said wire about said abutment, the bend being between said first leg and a second leg, and (iii) stop means spaced from said abutment for engaging a second leg of said wire after a predetermined amount of rotation of said wire bending means.

2. The tool for bending wire as claimed in claim 1, wherein said stop means is located in a position relative to said pushing means to establish the legs of a wire substantially parallel.

3. The tool for bending wire as claimed in claim 1, wherein said abutment is a conical post.

4. The tool for bending wire as claimed in claim 1, wherein said pushing means is a portion of an abutment flange located outwardly of said abutment.

5. The tool for bending wire as claimed in claim 1, wherein said stop means is a portion of a second abutment flange located outwardly of said abutment on said axis.

6. The tool for bending wire as claimed in claim 5, wherein said second abutment flange comprises a surface spaced from said pushing means sufficiently to provide a slot which permits entry of a wire.

7. The tool for bending wire as claimed in claim 6, wherein said pushing means and said surface provide a slot relatively wide at the entry thereof, and converging toward said abutment on said axis.

8. The tool for bending wire as claimed in claim 1, wherein said wire bending means comprises a generally axially extending flange outwardly of said abutment, said flange having an opening transversely therethrough, said pushing means being a boundary of said opening and said flange having a shoulder extending generally parallel to said axis, said shoulder being said stop means.

9. The tool for bending wire as claimed in claim 1, and a shaft extending axially from said wire bending means, a generally axially extending bore in said wire bending means and in said shaft, said abutment being a post extending into said bore.

10. The tool for bending wire as claimed in claim 9, said post having a cylindrical center section of substantially the same size as the bore, and an extension at either end thereof, at least one said extension being of smaller diameter than the center section.

11. The tool for bending wire as claimed in claim 10, and means for releasably holding said post in said bore.

12. The tool for bending wire as claimed in claim 10, and a magnet in said bore, said post being of magnetizable material for enabling said post to be releasably held in said bore.

13. The tool for bending wire as claimed in claim 1, and a wire pusher in combination therewith.

14. The tool for bending wire as claimed in claim 13, said wire pusher comprising an element of substantially S-shape profile.

15. The tool for bending wire as claimed in claim 13, said wire pusher having first and second arcuate portions, and an annular element concentrically in one said arcuate portion.

16. The tool for bending wire as claimed in claim 15, wherein one said arcuate portion is larger in arcuate extent than the other arcuate portion.

17. The tool as claimed in claim 1, and further comprising a first and a second abutment flange, each having at least one said pushing means and at least one said stop thereon and a blade extending inwardly from each of said abutments, said blades being coplanar so as to engage in the slot of a screw, said blades terminating outwardly of said abutment.

18. The tool as claimed in claim 17, said abutment being a post axially movable in said wire bending means, a shaft connected to said wire bending means and said handle, and a spring in said shaft for urging said post outwardly relative to said shaft.

19. A wire bending tool for forming a controlled bend in a wire to provide a predetermined amount of bending of said wire comprising:

(a) a wire bending head comprising:

a post having a longitudinal axis, a wire pusher spaced outwardly of said post and positioned to engage an element of the surface of a wire when a substantially opposite element of the wire engages the post, and a stop outwardly of said post and positioned to be engaged by said opposite element of the wire after the wire has been bent around the post a predetermined amount, and (b) handle means for supporting said head and for causing rotation thereof about said axis of said post.

20. The wire bending tool as claimed in claim 19, said stop being positioned to be engaged by said opposite element when said elements of said wire are substantially parallel.

21. For use with a wire bending tool, a wire pusher comprising elements of an S-shaped profile washer and having at least first and second oppositely facing arcuate portions, and an annular element concentrically in one said S-shaped element.

22. For use with a wire bending tool, a wire pusher as claimed in claim 21, wherein one said arcuate portion is larger in arcuate extent than said second arcuate portion.

* * * * *